United States Patent [19]

Popov et al.

[11] 4,088,609

[45] May 9, 1978

[54] CURRENT-CONDUCTING FILM FOR ELECTRIC RESISTANCE HEATERS

[76] Inventors: Gennady Petrovich Popov, Leninsky prospekt, 161, kv. 8; Alexandr Konstantinovich Mikhailidi, ulitsa Svobody, 55, kv. 96; Konstantin Andreevich Lavrentiev, ulitsa F. Engelsa, 42, kv. 43; Ivan Grigorievich Popov, Leninsky prospekt, 148, kv. 27, all of Voronezh; Viktor Vasilievich Zhukov, Proletarsky proezd, 12, kv. 25; Nikolai Alexeevich Sorokin, ulitsa Gagarina, 47, kv. 21, both of Klin, Moskovskaya oblast, all of U.S.S.R.

[21] Appl. No.: 722,412

[22] Filed: Sep. 13, 1976

[30] Foreign Application Priority Data

Dec. 8, 1975 U.S.S.R. ..... 2199248

[51] Int. Cl.$^2$ ..... H01B 1/02

[52] U.S. Cl. ..... 252/512; 252/518

[58] Field of Search ..... 252/512, 518

[56] References Cited

U.S. PATENT DOCUMENTS 3,740,350 6/1973 Shanefield ..... 252/512

OTHER PUBLICATIONS

Marton, J. P. et al., J. Electrochem. Soc., vol. 123, No. 2, 1976, pp. 234–238.

Dreyfus, Chem. Abs., vol. 64 (1966), 5914*g*.

Leja, Chem. Abs., vol. 74 (1971), 47100*a*.

Boehm et al., Chem. Abs., vol. 75 (1971), 14042*a*.

*Primary Examiner*—Benjamin R. Padgett

*Assistant Examiner*—E. Suzanne Parr

*Attorney, Agent, or Firm*—Lackenbach, Lilling & Siegel

[57] ABSTRACT

A current-conducting film for electric resistance heaters, consisting of tin dioxide, antimony and boron which are used in the following ratios in percent by weight: tin dioxide 78.0–96.8; antimony, 3.0–20.0 boron, 0.2–2.0. The current conducting film exhibits high thermal stability (up to 900° C in air), critical specific input of 60 W/cm$^2$ with strong adhesion to a support and good reproducibility of electrical parameters and physical properties.

1 Claim, No Drawings

CURRENT-CONDUCTING FILM FOR ELECTRIC RESISTANCE HEATERS

The invention relates to the electrical engineering, and more particularly to current-conducting films for electric resistance heaters. Such heaters are used for heating aggressive and non-aggressive media, e.g. acids, alkalies, solvents, deionized water, gases and the like.

Known in the art is a current conductor consisting of tin dioxide with the addition of fluorine (cf. USSR Inventor's Certificate No. 142000) which is used for the manufacture of electric resistance heaters of various shapes.

This film exhibits strong adhesion to a support and good reproducibility of electrical parameters (resistance, specific input) and physical properties (structural and thickness uniformity). However, this current conductor has low electric conductance, inadequate thermal stability (only up to 200°-250° C in air) and critical specific input as low as 20 W/cm$^2$.

Known in the art is also a current conductor for electric resistance heaters, consisting of tin dioxide with addition of antimony (of. Jr. "Pribory i tekhnika eksperimenta", No. 4, p. 993, 1958).

Due to the presence of antimony (up to 5%), this current-conducting film exhibits better properties than that described above, and namely, higher electric conductance, better thermal stability (up to 400°-450° C in air) and higher critical specific input (up to 30 W/cm$^2$). It should be noted that further increase of antimony content in the film results in impaired reproducibility of electrical parameters and physical properties of the film and weaker adhesion to a support, thus making the film practically unsuitable for electric heaters. These disadvantages are due to the fact that with an increase of the percentage of antimony, the shape of crystals during the formation of the film are distorted, their four-fold rotors cease to be normal to the support plane and the size of crystals increases to 1.7-2.0 microns (with 8% by weight of antimony).

It is an object of the invention to provide a current conducting film for electric resistance heaters, which exhibits high thermal stability and specific input with strong adhesion to a support and good reproducibility of electrical parameters and physical properties.

With this and other objects in view, the invention consists in the provision of a current conductor for electric resistance heaters, consisting of tin dioxide, antimony and boron, the components being used in the following ratios (percent by weight):

tin dioxide — 78.0-96-8
antimony — 3.0-20.0
boron — 0.2-2.0

The current conductor according to the invention exhibits high thermal stability (up to 900° C in air), critical specific input of up to 60 W/cm$^2$ with strong adhesion to a support and good reproducibility of electrical parameters and physical properties.

Boron is characterized by a fine crystalline structure with a crystal size smaller than 0.1 micron. The addition of boron to the composition of the film decelerates the growth of crystals during the film formation. Crystal size in the film is reduced (for instance, with antimony content of 8% by weight, crystal size is 0.3-1.0 micron). The addition of fine crystalline boron to the film permits an increase of antimony percentage in the film up to 20% by weight, thereby improving film properties (electric conductance, specific input and thermal stability) without impairing the adhesion of film to a support. Boron provides good reproducibility of electrical parameters and physical properties of the film because it controls the film structure to determine the shape, orientation and size of crystals. Thus, boron improves the crystallographic structure of film. In addition, being a refractory material, with melting point of 2030° C, boron improves thermal stability of the film.

The film according to the invention is applied to a support which may be of varied shape by pulverizing alcohol solutions of $SnCl_4.5H_2O$ with the addition of antimony and boron chlorides. The support temperature is within the range from 600° to 900° C. The support may be made of various dielectric materials, such as quartz or ceramic. The combination of support with a current conducting film of 1-3 micron thickness applied thereto and lead conductors which may be formed by the method of heat treatment of silver pastes represents an electric resistance heater. The heated medium is not in contact with the current conducting film. The current conducting film can be used in vacuum, in neutral and oxidizing media.

The Table below illustrates examples of various compositions of the current conducting film and basic electrical parameters and physical properties. The current conducting film was applied to a cylindrical quartz support with a surface area of 140 cm$^2$. The adhesion of the film to the support was measured as the time required to grind the film off the support using diamond powder with grain size of 0.6-1 micron.

The use of the current conducting film according to the invention enables two-threefold improvement of the capacity of electric resistance heaters of various shapes for heating various media, as well as considerable improvement of reliability of electric resistance heaters. Thus, the service life of the heaters used for heating deionized water is of 8000-10000 hours.

Table

| Example No. | Film composition in wt.% | | | Thermal stability of film in air (critical temperature) in ° C | Electric conductance Ohm$^{-1}$ | Critical specific input, W/cm$^2$ | Film crystal size, mcm | Adhesion of film to support, minutes |
|---|---|---|---|---|---|---|---|---|
| | Tin dioxide | Antimony | Boron | | | | | |
| 1 | 78.0 | 20.0 | 2.0 | 900 | 0.002 | 60 | 0.8-2.0 | 15 |
| 2 | 88.5 | 10.0 | 1.5 | 850 | 0.009 | 51 | 0.4-0.8 | 18 |
| 3 | 94.0 | 5.5 | 0.5 | 500 | 0.00009 | 45 | 0.3-0.7 | 20 |
| 4 | 96.8 | 3.0 | 0.2 | 400 | 0.00001 | 38 | 0.2-0.6 | 25 |

What is claimed is:

1. A current conducting film for electric resistance heaters, consisting of tin dioxide, antimony and boron, the components being used in the following ratios, in percent by weight:

tin dioxide — 78.0-96.8
antimony — 3.0-20.2
boron — 0.2-2.0.

* * * * *